United States Patent [19]

Shipp

[11] 4,310,009

[45] Jan. 12, 1982

[54] COMBING AND APPLICATOR DEVICE

[76] Inventor: Anthony D. Shipp, 351 N. Foothill Rd., Beverly Hills, Calif. 90210

[21] Appl. No.: 65,851

[22] Filed: Aug. 13, 1979

Related U.S. Application Data

[63] Continuation-in-part of Ser. No. 871,192, Jan. 23, 1978, abandoned.

[51] Int. Cl.[3] ..... A45D 40/30

[52] U.S. Cl. ..... 132/88.5

[58] Field of Search ..... 132/114, 9, 11 R; 222/564, 478

[56] References Cited

U.S. PATENT DOCUMENTS

| | | | |
|---|---|---|---|
| 678,004 | 7/1901 | Myers | 132/114 |
| 1,113,843 | 10/1914 | Smith | 132/114 |
| 2,295,746 | 9/1942 | Metzler | 132/114 |
| 2,905,364 | 9/1959 | Marraffino | 222/564 |
| 3,311,275 | 3/1967 | Gibson | 222/564 |
| 3,333,745 | 8/1967 | Hartley et al. | 222/564 |

FOREIGN PATENT DOCUMENTS

| | | | |
|---|---|---|---|
| 1051690 | 9/1953 | France | 132/114 |
| 643633 | 9/1950 | United Kingdom | 132/114 |

*Primary Examiner*—G. E. McNeill

*Attorney, Agent, or Firm*—Lyon & Lyon

[57] ABSTRACT

There is disclosed a Combing and Applicator Device for applying treatment substance to a skin surface comprised of a housing formed with a base and shoulder portion and having a conduit means for passing treatment substance therethrough. The inlet of the conduit is in the base portion of the housing and the outlet of the conduit is in the shoulder portion thereof. The base portion is preferably provided with an attachment means for attachment and communication of the inlet of the conduit with a container of treatment substance. The outlet portion of the conduit is in the shoulder portion of the housing and comprises hollow teeth which are utilized to both comb and apply the treatment substance to the skin surface desired. Between the inlet and outlet portions of the conduit there is a baffle for even distribution of fluid to the hollow teeth.

18 Claims, 4 Drawing Figures

COMBING AND APPLICATOR DEVICE

RELATED APPLICATION

This application is a continuation-in-part of my earlier filed United States Patent Application, Ser. No. 871,192 filed Jan. 23, 1978 now abandoned.

BACKGROUND

The present invention relates to a combing and applicator device with particular use for applying a treatment substance such as a treatment fluid or a treatment powder directly to the surface of the scalp.

The present combing and applicator device comprises of a housing formed with a base and shoulder portion and having a conduit means passing therethrough to transfer fluid or powder from a container through hollow teeth to the surface of the skin. The inlet portion of the conduit is located in the base portion of the housing which is provided with means for attachment to a container of treatment substance. The outlet portion of the conduit is located in the shoulder portion of the housing and comprises a series of hollow teeth which are utilized to both comb and apply the treatment substance to the skin surface. Between the inlet and outlet portions of the conduit there is a baffle means preferably located in a chamber adjacent to the hollow teeth which is used to evenly distribute the flow of fluid to the hollow teeth.

One of the primary uses for the present invention is to apply disinfectant solution, insecticide or the like to the skin of pets in order to treat them for fleas and other parasites which they may be infected with.

Pet owners have in the past frequently found it difficult and unpleasant to treat their pets with insecticides and the like because to effectively do so means having to rub the insecticide into the fur of the animal so it penetrates and comes in contact with the surface of the skin.

Getting the liquid or the powder solution to come in contact directly with the skin has been a particular problem in the many instances where the coat of the animal is very heavy. Moreover, pets normally also do not enjoy being treated with disinfectant, and contribute substantially to the difficulty and unpleasantness in their treatment.

The present invention solves these problems by making the application of the treatment substance directly to the skin easy and free from problems. The pet is not excessively disturbed, and the pet owner accordingly has a more pleasant task in the application of the treatment formula.

Moreover, the present applicator is light, and portable which contributes to its very easy use. Additionally, the present applicator distributes fluid or powder evenly through each tooth to the surface of the scalp. While the primary use of the claimed device is to treat pets with insecticides and the like, the claimed device may also be utilized to treat the scalps and skins of humans.

Several prior art combing devices have been adapted to enable the device to dispense such scalp-treating substances. These devices generally comprise a conduit formed in the spine of a comb which was in fluid communication with hollow passageways formed in one or more of the teeth of the comb. The conduit was adapted to enable it to be connected to a fluid container. The teeth are opened at their ends to enable the treatment fluid to flow from the container, through the conduit, through the passageways in the teeth and onto the scalp. To applicant's knowledge, none of the prior art devices teach the specific features of the claimed invention and specifically, the baffle to effectuate even distribution of fluid. Moreover, the open ends of the hollow teeth of the known prior art devices are flat making it difficult to dispense fluid when the open ends of the teeth are resting flush on the scalp.

SUMMARY OF THE INVENTION

It is therefore the object of the present invention to provide a combing and applicator device which enables the application of treatment fluid evenly and directy onto the surface of the scalp during the combing operation.

This and other objects and advantages are obtained by forming a combing and applicator device comprised generally of a housing formed with a base portion and shoulder portion, and having a conduit therethrough to transfer fluid from a container directly to the scalp by means of the hollow teeth. The base portion of the housing is preferably provided with a valve means and attachment means or collar. The valve means functions to regulate the flow of treatment substance and the collar functions to enable the conduit to be connected to treatment substance containers.

The shoulder portion of the housing contains the outlet of the conduit comprising a plurality of hollow teeth. The teeth are preferably curved. The passageways in the hollow teeth are in fluid communication with the conduit which extends through both the shoulder and base portion of the housing. The ends of the hollow teeth are opened and are sometimes provided with one or more slots which enable the application of treatment fluid directly onto the surface of the scalp during the combing operation.

BRIEF DESCRIPTION OF THE DRAWINGS

A more thorough disclosure of the objects and advantages of the present invention is presented in the detailed description which follows and from the accompanying drawings in which.

DESCRIPTION OF PREFERRED EMBODIMENT

Figure 1:
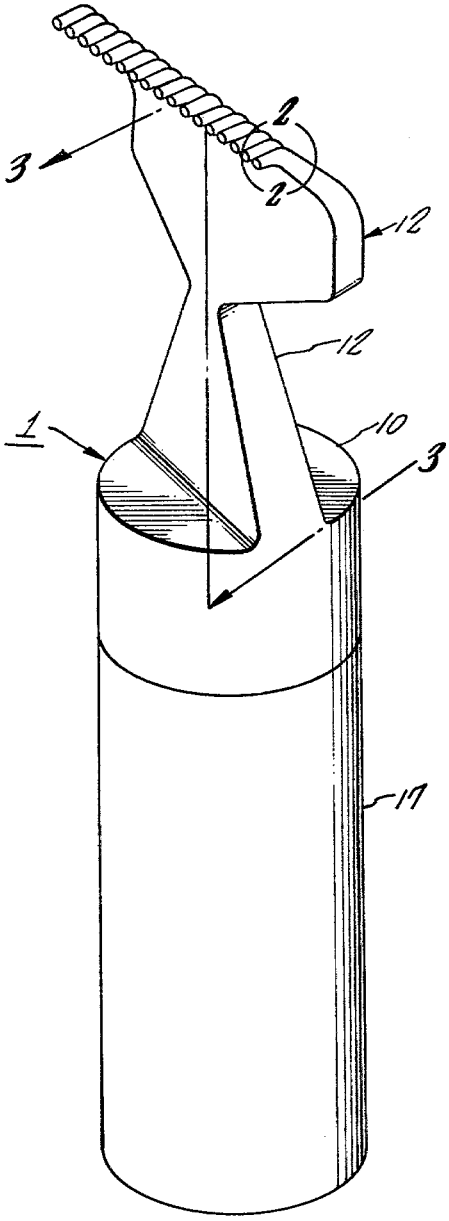
FIG. 1 is a perspective view of the combing and applicator device of the present invention.
Figure 3:
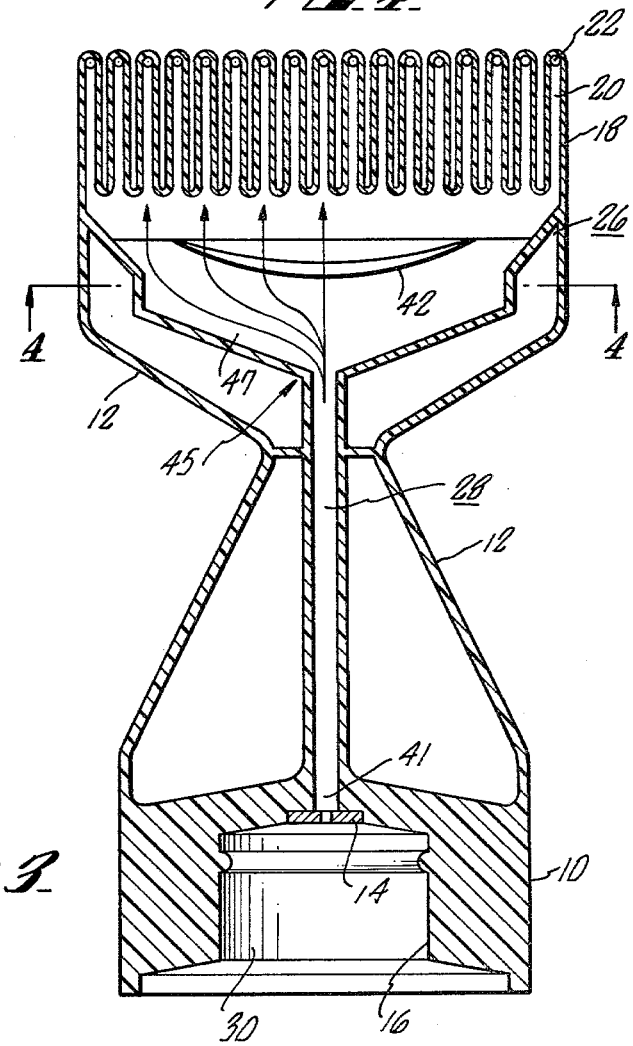
FIG. 3 is a sectional view of the device of the present invention taken along lines 3—3.

The drawings illustrate the preferred embodiment of a combing and applicator device according to the present invention. Referring to FIGS. 1 and 3, there is shown a combing and applicator device comprising generally of housing 1 having a base portion 10 integrally formed and a shoulder portion 12. The housing has a conduit 28 for transferring fluid therethrough, the conduit inlet 41 being located in the base of the housing and the conduit outlet comprising hollow teeth 18. The base portion of the housing is preferably provided with a valve means 14 and collar or attachment means 16. Valve means 14 can be any suitable type of valve which can be adjusted to regulate the flow of treatment fluid through the device. Collar 16 is preferably threaded or provided with clips or protrusions or the like to enable the collar to be connected to treatment fluid container 17.

Figure 2:
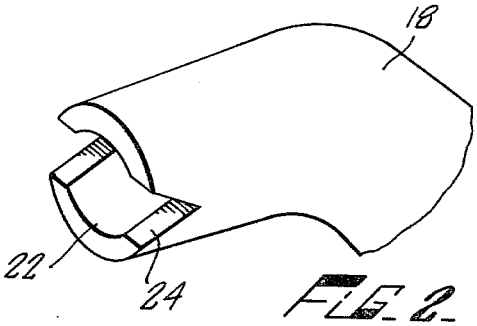
FIG. 2 is an enlarged perspective view of the end of one of the hollow teeth of the present invention.

The shoulder portion 12 is provided with a plurality of teeth 18. The teeth 18 are preferably curved and at least one and preferably a substantial number of the teeth are provided with hollow passageways 20 having open ends 22. Referring to FIG. 2, the open ends 22 of the teeth 18 are provided with one or more slots 24. Slots 24 can be of any suitable shape such as V-shape and are preferably formed at the side of the teeth to prevent clogging of the slots during the combing operation. The slots function to enable discharge of treatment fluid directly on the surface of the scalp during the combing operation while the open ends of the teeth are being moved along the surface of the scalp.

Passageways 20 open into chamber 26 which is in fluid communication with and comprises part of conduit 28. Conduit 28 runs through both the shoulder portion and the base portion of the device and has its outlet in area 30 defined by collar 16.

Although the chamber is not necessary in some embodiments; in the preferred embodiment chamber 26 is located between the inlet and outlet portions of the conduit preferably in an area adjacent to and in communication with the hollow teeth.

Baffle means 42 is located within this chamber which serves to alter the flow of the fluid so that it flows evenly to the hollow teeth and is therefore evenly distributed on the scalp.

In the preferred embodiment the hollow teeth lie in a row in substantially the same plane. Conduit 28 communicates with chamber 26 which is in affect an expansion of the conduit 28, to allow fluid communication with each of the hollow teeth 18. In the preferred embodiment, baffle means 42 is an elongated ridge which provides a graduated obstacle to the flow of fluid, analogous to a speed bump in a shopping center, causing direct flow of fluid to be slowed and proportionally dampened, thus equalizing the flow of fluid to each hollow tooth.

In the present embodiment conduit means 28 expands into chamber 26 at point 45. Fluid is thus introduced to the chamber 26 at point 45 and is thereafter routed to the hollow teeth. The walls of the chamber 26 slope outwardly from point 45 so as to allow communication with the whole row of hollow teeth. Because of the geometry of the chamber, fluid flow from conduit means 28 to the hollow teeth would have a tendency to be greater in the area in the center of the comb or at the entrance to the teeth located closest to neck 45. The baffle means 42 is graduated so as to provide the greatest obstacle to flow in the area closest to the neck thus equalizing the fluid pressure and forcing fluid flow to be evenly rerouted to the hollow teeth so as to obtain substantially constant and even flow through each tooth and to the scalp. Arrows 47 illustrate the flow paths to the hollow teeth from neck 45 over and around baffle means 42.

Figure 4:
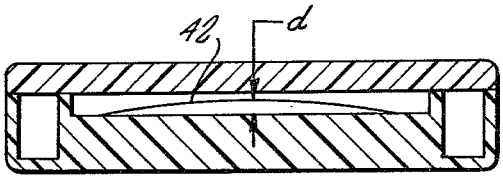
FIG. 4 is a sectional view of the device taken along lines 4—4.

FIG. 4 illustrates a side view of baffle 42. Baffle 42 is a graduated obstacle or wall. It is noted that the height of baffle 42 is higher at the center than on the ends. This is indicated by the letter 'd' in FIG. 4, which is greatest in the center of the chamber adjacent to the center teeth and decreases progressively towards the vicinity of the end teeth. It is also noted that in the preferred embodiment, the chamber 26 extends along the entire length of the teeth to allow communication with each tooth, while the baffle extends at least along a portion of this length. Moreover, the chamber 26 is flat and rectangular in nature and tapers outwardly from the neck to allow smooth and aerodynamic flow from the neck 45 to the hollow teeth.

To utilize the combing and applicator device of the present invention, the device is first attached to a container 17 of scalp treating fluid by preferably connecting collar 16 to the top of the container. If desired, the device can be initially used as a combing device by closing valve means 14. When it is desired to apply treatment fluid to the scalp, valve means 14 is open. Treatment fluid is then caused to flow from the container 17 into conduit inlet 41 by the force of gravity or by squeezing container 17 or the like. The treatment fluid then flows through conduit 28, chamber 26 and out of the outlet of the conduit through hollow teeth 18. Baffle 42, located in chamber 26, dampens the flow of fluid causing the flow of fluid to be altered and evenly distributed. This is effectuated by rerouting some of the flow to the outside teeth furthest away from where the fluid is introduced into chamber 28. As explained, this is accomplished by providing the greatest dampening from the baffle where the concentration of flow is the greatest which in the present embodiment would be in the vicinity of the center teeth.

In a preferred embodiment, fluid is dispensed directly to the surface of the scalp through slots 24 during the combing operation while the open ends of the teeth are moved along the surface of the scalp. Thus the device facilitates the application of treatment fluid evenly and directly onto the surface of the scalp during the combing operation. The combing operation also stimulates the surface of the scalp thereby increasing blood circulation and fluid absorption. The device thus enables a more effective treatment of the scalp with increased absorption of the treatment fluid into the scalp.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A combing and applicator device for applying treatment substance from a container to a surface comprising:

a housing means for attaching to said container and having a conduit means for passing treatment substance therethrough;

said conduit means having an inlet means disposed in communication with the container when said container is attached to the housing and having an outlet means comprising of a plurality of hollow teeth;

said conduit means having a chamber between the inlet and outlet means and adjacent to said hollow teeth; and baffle means located in said chamber in the proximity of said hollow teeth, for equalizing the flow of fluid to each of said hollow teeth.

2. The device in claim 1 wherein the baffle means is integral with said housing.

3. The device in claim 1 wherein the baffle is doubly curved, once towards the chamber with the highest barrier in the middle, and twice towards the teeth to optimize a smooth laminar flow evenly to all of the teeth.

4. The device in claim 1 wherein the chamber is substantially rectangular in cross-section, with a parallel top and bottom, and with outwardly sloping sides extending along the entire length of the teeth allowing smooth and equalized flow to said hollow teeth.

5. The device in claim 1 wherein the teeth are curved.

6. The device in claim 1 wherein the chamber is flat and extends along the entire length of the teeth allowing communcation with the same.

7. The device in claim 1 wherein the baffle is curved into the chamber providing the highest barrier in the center of the baffle to direct some, but not all of the flow away from the center teeth.

8. The device in claim 7 wherein the baffle is also curved into the teeth to optimize smooth aerodynamic flow to the teeth.

9. The device in claim 6 wherein the baffle means extends at least along a portion of the entire length of the teeth.

10. The device in claim 9 wherein the baffle means is tapered and higher in the middle than at each end.

11. The device in claim 10 wherein said teeth have open ends provided with at least one slot at the outlet ends for combing and applying fluid directly to the surface.

12. The device in claim 4 wherein the baffle is integral with the housing and varies in height to provide the greatest obstacle in the vicinity of the center teeth, allowing smooth and equalized flow to said hollow teeth.

13. A combing and applicator device for applying treatment substance from a container to a surface comprising:

a housing means for attaching said container and having a conduit means for passing treatment substance therethrough;

said conduit means having an inlet means disposed in communication with the container when said container is attached to the housing and having an outlet means comprising of a single row of hollow teeth;

said conduit having a chamber between the inlet and outlet means and adjacent to said hollow teeth; and baffle means located in said chamber adjacent to and extending at least a portion of the entire length of the teeth for equalizing the flow of fluid to said hollow teeth.

14. The device in claim 13 wherein the baffle is curved into the chamber providing the highest barrier in the center of the baffle to direct some, but not all of the flow away from the center teeth.

15. The device in claim 13 wherein the baffle is doubly curved, once towards the chamber with the highest barrier in the middle, and twice towards the teeth to optimize a smooth laminar flow evenly to all of the teeth.

16. The device in claim 13 wherein the chamber is substantially rectangular in cross-section with a parallel top and bottom, and with outwardly sloping sides extending along the entire length of the teeth allowing smooth and equalized flow to said hollow teeth.

17. The device in claim 14 wherein the baffle is also curved into the teeth to optimize smooth aerodynamic flow to the teeth.

18. The device in claim 16 wherein the baffle is integral with the housing and varies in height to provide the greatest obstacle in the vicinity of the center teeth, allowing smooth and equalized flow to said hollow teeth.

* * * * *